United States Patent [19]

Huang

[11] Patent Number: 4,746,032

[45] Date of Patent: May 24, 1988

[54] QUICK-RELEASE RESEALABLE BEVERAGE CAN COVER ASSEMBLY

[75] Inventor: Dar S. Huang, No. 142, Lan Keng Li, Tou Fen Jenn, Miaoli Hsien, Taiwan

[73] Assignees: Meei Huey Tai, Chang Hwa; Dar Sheng Huang, Miaoli Hsien, both of Taiwan

[21] Appl. No.: 86,714

[22] Filed: Aug. 18, 1987

[51] Int. Cl.[4] ..... B65D 43/20

[52] U.S. Cl. ..... 220/256; 220/346

[58] Field of Search ..... 220/254, 256, 345, 346, 220/347

[56] References Cited

U.S. PATENT DOCUMENTS

| | | | |
|---|---|---|---|
| 1,090,264 | 3/1914 | Adams | 220/346 |
| 4,113,134 | 9/1978 | Heintzelman | 220/256 |
| 4,170,724 | 10/1979 | Waterbury | 220/346 |

*Primary Examiner*—Donald F. Norton

*Attorney, Agent, or Firm*—Poms, Smith, Lande & Rose

[57] ABSTRACT

A beverage can lid having a safety rim which exposes no sharp surfaces and which forms a cavity on the inner surface thereof. An upper slide piece which covers and which grips the safety rim. The upper slide piece has a push knob on its upper face. A lower slide piece which has an insert projecting upwards from its upper surface. The lower slide piece and upper slide piece are plastically welded together at the apex of the insert, which fits in the cavity of the push knob of the upper slide piece. The lower slide piece fits in the rim and contacts the inside of the lip of the rim so as to seal the can until the user pushes on the push knob. The upper and lower slide pieces are flexible so that the beverage can can be resealed if slid back into original position.

1 Claim, 5 Drawing Sheets

QUICK-RELEASE RESEALABLE BEVERAGE CAN COVER ASSEMBLY

BACKGROUND OF THE INVENTION

This invention relates to a quick-release resealable beverage can cover assembly and in particular relates to such a beverage can cover assembly which is slidably resealable.

In the past, beverage can easy-open assemblies, often called "pop tops", have suffered from several drawbacks. Firstly, with the conventional beverage can top it is easy for the user to cut himself on the sharp edges of the tab portion thereof or the opening formed by the removal thereof. In addition, when the user opens the can, he often throws the tab portion on the ground or the street, thereby creating both a litter problem and a safety hazard (due to the sharp edges of the tab). A second problem with conventional beverage can quick-release tops is that they are not resealable. Therefore if the user wants to reclose the can lid, he has no convenient and sanitary method of doing so.

It is the purpose of this present invention, therefore, to mitigate and/or obviate the above-mentioned drawbacks in the manner set forth in the detailed description of the preferred embodiment.

SUMMARY OF THE INVENTION

A primary objective of this invention is to provide an easy-open cover assembly for beverage cans which is resealable.

Another objective of this invention is to provide an easy-open cover assembly for beverage cans which exposes no sharp edges after usage thereof.

A further objective of this invention is to provide an easy-open cover assembly for beverage cans which is not separable from the rest of the beverage can.

Further objectives and advantages of the present invention will become apparent as the following description proceeds, and the features of novelty which characterize the invention are pointed out with particularlity in the claims annexed to and forming a part of this invention.

DETAILED DESCRIPTION OF THE PREFERRED EMBODIMENT

Figure 1:
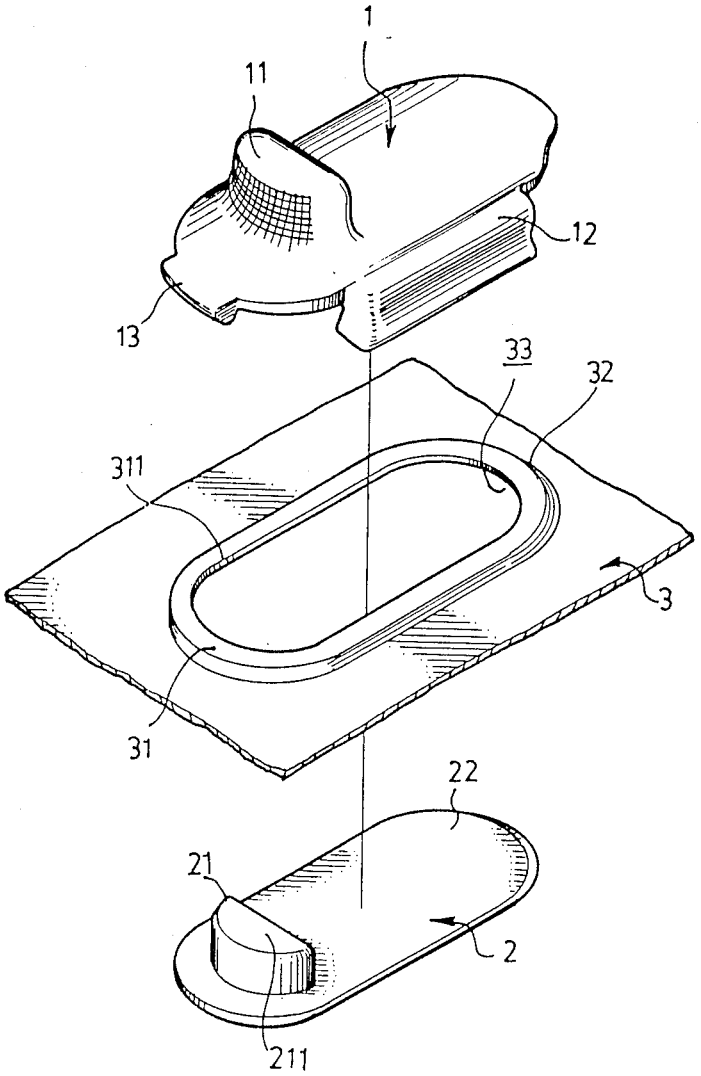
FIG. 1 is an exploded view of an easy-open slidably retained beverage can cover assembly in accordance with the present invention.

Referring to FIG. 1, it can be seen that the present invention comprises an upper slide piece 1, a lower slide piece 2, and of course a can lid 3 with a safety rim 31 thereon. The upper slide piece 1 comprises a push knob

Figure 6:
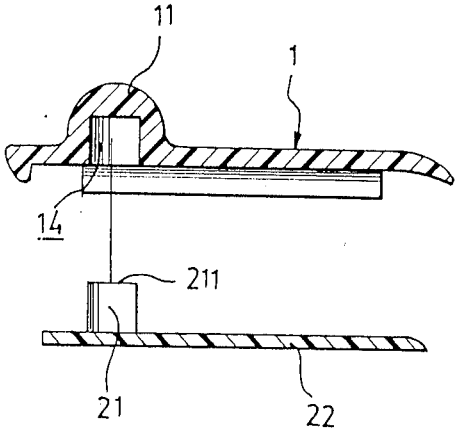
FIG. 6 is a cross-sectional view of the upper slide piece taken lengthwise therealong.

11 projecting substantially vertically upwards from one end of the top surface thereof, two side grips 12, and a retainer clip 13. The retainer clip 13 forms an integral piece with and extends outward from the lateral end of the upper slide piece 1 closest to the crimped circular edge of the can lid 3. The lower slide piece 2 has an insert 21 projecting from the top surface thereof. During assembly, the apex 211 of the insert 21 is plastically heat welded to said insert cavity 14 (see FIG. 6). When assembled, the insert 21 of the lower slide piece 2 and the upper slide piece 1 are heat treated at the apex 211 of the insert 21 and at the uppermost part of the insert cavity 14 so as to be plastically welded together. Preferably, the can lid 3, with its cover assembly (i.e. the upper and lower slide pieces, 1 and 2, after assembly), is first manufactured and then the completed can lid 3 is crimped on the top edge of the can wall 4. The side grips 12 are pre-stressed so as to push inwardly against the lower outer edges of the safety rim 31 and tightly retain the upper slide piece 1 thereon. These side grips 12 also help to keep the rim 31 clean during distribution of the beverage cans.

Figure 2:
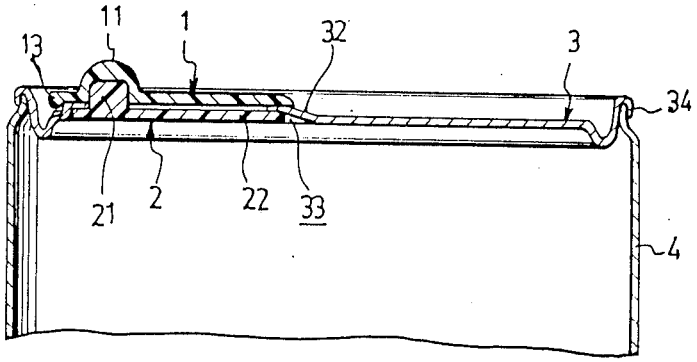
FIG. 2 is a cross-sectional view taken longitudinally along the upper and lower slide pieces and can lid of a cover assembly in accordance with the present invention, in closed (sealed) position.
Figure 3:
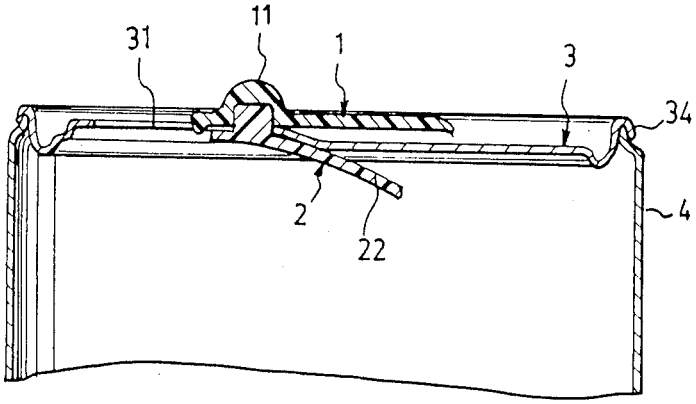
FIG. 3 is the same as FIG. 2, except that the upper and lower slide pieces are in open (unsealed) position.

In FIG. 2 and 3, cross-sectional views of the cover assembly of the present invention can be seen in closed (sealed) and open (unsealed) position, respectively. Note that the lower slide piece 2 fits tightly into the cavity 33 on the inside of the safety rim 31. Both the upper slide piece 1 and the lower slide piece 2 are made out of some type of flexible plastic or some other suitable elastic material. Because the inside surface of the lip 311 (see FIG. 1) and the upper outer edges of the lower slide piece 2 overlap each other, the beverage can is sealed on the inside thereof, as shown best in FIG. 2. In FIG. 3, the cover assembly of the present invention is shown in open (unsealed) position. In this position, the main flap 22 of the lower slide piece 2 is deflected by the deflector 32. However, since the main flap 22 is made of a flexible material, it is not permanently deformed when put into open position, but automatically restores itself to its original closed position (see FIG. 2) when the cover assembly is slide back to closed position so as to re-seal the drink can.

Figure 4:
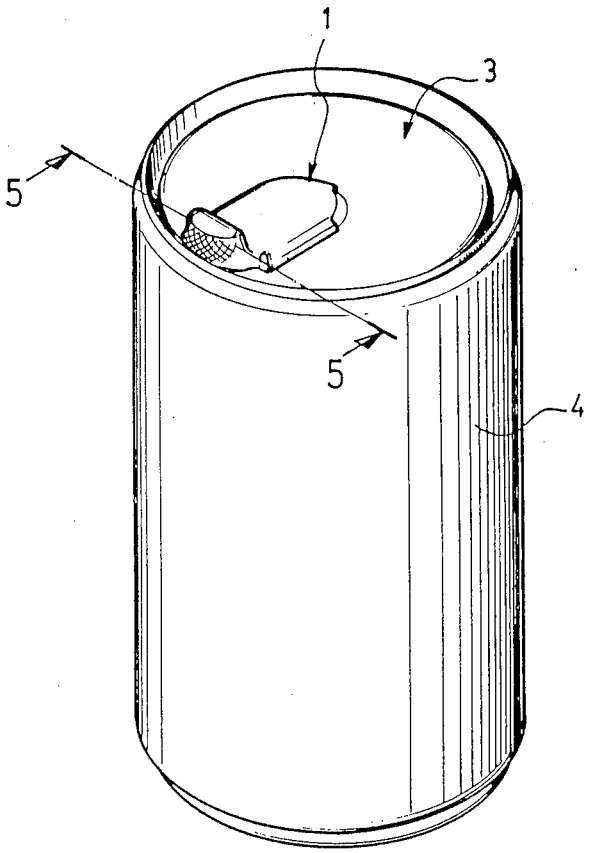
FIG. 4 is a working view of the present invention on a beverage can.

Now the actual operation of the present invention will be described. After assembly, a beverage can incorporating the present invention is, of course, in closed and sealed position, as shown in FIG. 2 and 4. To open the can, the user simply pushes on the push knob 11 portion of the upper slide piece 1 so that the push knob 11 is urged towards the center of the can lid 3. When the user starts pushing, the retainer clip 13 is urged upwards onto the lip 311 so that the upper slide piece 1 is free to slide. The retainer clip 13 is also flexible and has a rounded bottom surface so that with a moderate amount of effort it can be slid onto the lip 311 (see FIG. 1) of the safety rim 31. As the push knob 11 is slid towards the center of the can lid 3, the main flap 22 of the lower slide piece 2 is deflected away from the upper slide piece 1 by a deflector 32, until the cover assembly is fully opened, as seen in FIG. 3.

Figure 5:
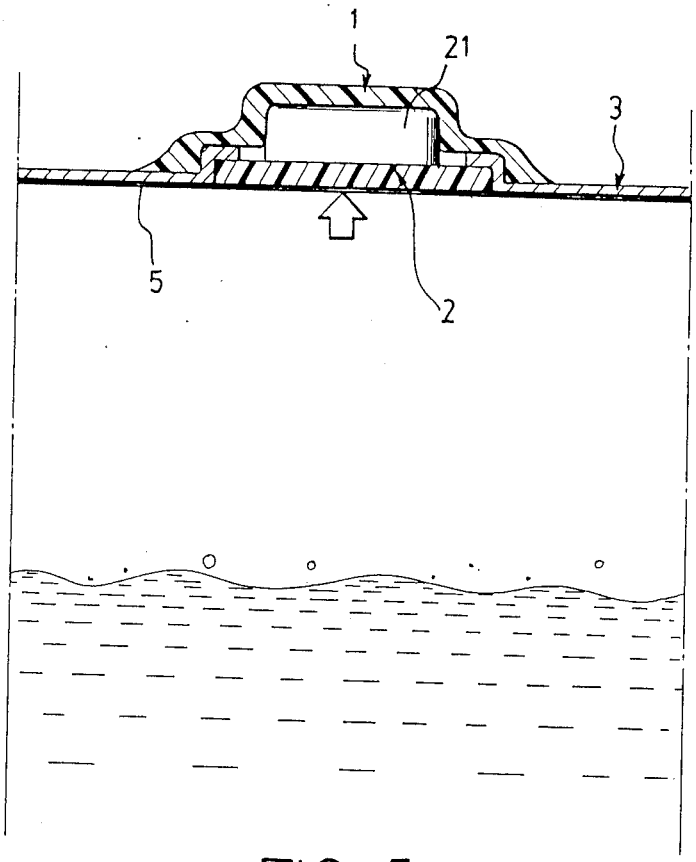
FIG. 5 is a cutaway view taken along line 5—5 of FIG. 4, showing the condition on the inside of the beverage can before opening.

Now referring to FIG. 5, it can be seen that after the upper slide piece 1 and the lower slide piece 2 are assembled a smooth protective seal coating 5 is put on the lower surface of the can lid 3 and on the lower surface of the lower slide piece 2 for further sealing the can and insuring no leakage of carbonation pressure.

As various possible embodiments might be made of the above invention without departing from the scope of the invention, it is to be understood that all matter herein described or shown in the accompanying drawing is to be interpreted as illustrative and not in a limiting sense. Thus it will be appreciated that the drawings are exemplary of a preferred embodiment of the invention.

I claim:

1. A quick-release resealable cover assembly for use on beverage cans comprising:

(A) a can lid (3) with a safety rim (31) thereon;

(B) an upper slide piece (1); said upper slide piece (1) having a push knob (11) projecting substantially vertically upwards from a top surface thereof; a retainer clip (13) forming an integral piece with and extending outwards from a lateral end of said upper slide piece (1) closest to a crimped edge of the can lid (3); said retainer clip (13) being rounded on a bottom surface thereof; said upper slide piece (1) also having side grips (12) on two lengthwise sides thereof; said side grips (12) being pre-stressed to push inwardly against a lower outer edge of said safety rim (31);

(C) a lower slide piece (2); said lower slide piece (2) having an insert (21) projecting from a top surface thereof; an apex (211) of said insert (21) being plastically welded to said insert cavity (14) of said upper slide piece (1); and (D) a protective and sealing coating on the lower surface of said can lid (3) and said lower slide piece (2).

* * * * *